United States Patent [19]

Schoenrock et al.

[11] 4,045,242

[45] Aug. 30, 1977

[54] PROCESS FOR THE PURIFICATION OF SUGARBEET JUICE AND THE REDUCTION OF LIME SALTS THEREIN

[75] Inventors: Karlheinz W. R. Schoenrock; Hugh G. Rounds, both of Ogden, Utah

[73] Assignee: The Amalgamated Sugar Company, Ogden, Utah

[21] Appl. No.: 747,095

[22] Filed: Dec. 3, 1976

Related U.S. Application Data

[63] Continuation-in-part of Ser. No. 715,182, Aug. 17, 1976, abandoned.

[51] Int. Cl.[2] ..... C13D 3/06

[52] U.S. Cl. ..... 127/50; 127/55

[58] Field of Search ..... 127/50, 55

[56] References Cited

U.S. PATENT DOCUMENTS 3,887,391 6/1975 Schoenrock ..... 127/50 X

*Primary Examiner*—Sidney Marantz

*Attorney, Agent, or Firm*—Pierce, Scheffler & Parker

[57] ABSTRACT

A method for decalcifying raw sugar juice by the addition of active MgO to the final carbonation gassing vessel, carbonating to an alkalinity of about 0.01% CaO equivalent, and then re-alkalizing in a secondary reaction vessel with additional active MgO to an alkalinity of about 0.025% CaO equivalent.

1 Claim, No Drawings

PROCESS FOR THE PURIFICATION OF SUGARBEET JUICE AND THE REDUCTION OF LIME SALTS THEREIN

This application is a continuation-in-part of our copending application Ser. No. 715,182 filed Aug. 17, 1976, abandoned .

This invention relates to the art of recovering sugar from sugarbeet juice and involves purifying such juice.

In the conventional procedure for purifying sugarbeet juice, lime is added to the juice extracted from the beets, and carbon dioxide is then introduced, which causes the precipitation of calcium carbonate as a mass of fine crystals. This is generally known as "main carbonation" or "main carbonatation". Enough lime and carbon dioxide is added to effect light juice color and to ease the separation (filtration or decantation) of the carbonate "mud."This usually takes place in an alkalinity range of 0.065 to 0.100% CaO. Purification is accomplished primarily by caogulation, precipitation of insoluble calcium salts, and by the absorption of juice impurities by the fine calcium carbonate crystals.

In the conventional process, this "main carbonation" is followed by a final carbonation to reduce the remaining lime salts in the juice to a minimum. This final carbonation is necessary to minimize scaling and fouling of the heating surfaces in the evaporators (or concentrators) which require expensive chemical cleaning when dirty. In the conventional final carbonation, chemical additives such as soda ash are used to reduce the lime salts to acceptable limits. We have now discovered how magnesium oxide can be used rather than soda ash for minimizing lime salts, which allows substantial process savings.

In U.S. Pat. No. 3,834,941 issued Sept. 10, 1974, to Karlheinz W. R. Schoenrock, Chia-Lung Hsieh, and Hugh G. Rounds, we disclosed and claimed an improved purification process predicated on the concept that a more desirable reaction occurs when small amounts of the oxides of the alkaline earth metals are added after the main carbonation and/or final carbonation steps, rather than before and/or during the respective carbonation procedures, as has been commonly practiced. The addition of the oxides after carbonation leads to the formation of insoluble calcium carbonate, which is a more effective adsorbant for undesirable impurities, forms a more easily filterable precipitate, and leaves a lower residue of soluble calcium salts in the final juice. Any of the oxides of the alkaline earth metals may be employed in this technique, but the oxide of calcium (CaO) or its respective hydroxide ($Ca(OH)_2$) is preferred as the additive after main carbonation, while the oxide of magnesium (MgO) is preferred as the additive after the final carbonation step.

The reaction disclosed in said patent proceeds when carried out in two steps. In the first step, an excess of carbon dioxide is added to the juice to convert prevailing hydroxides to carbonates and/or bicarbonates. In the second step, the mixture thus carbonated is transferred to a secondary reaction vessel where sufficient alkaline earth metal oxides and/or hydroxides are added to raise the alkalinity to the optimum point conducive to maximum juice quality. Where applicable, temperatures are raised, preferably in the secondary reaction vessel, to complete the destruction of bicarbonates.

However, under conditions of extremely low so-called effective alkalinity, it is not possible to introduce sufficient carbon dioxide during the final carbonation step in order to solubilize the quantity of active magnesium oxide necessary to displace all the calcium in its lime salts and precipitate said calcium in the form of calcium carbonate after said calcium reacted with the carbon dioxide introduced during the overcarbonation of the final carbonation step accoding to aforesaid U.S. Pat. No. 3,894,941. This is so because of the well-known instability of the carbonic acid under the conditions of high temperature and atmospheric pressure prevailing in the carbonation vessels during the final carbonation step.

According to the present invention, the absorption of carbon dioxide during said final carbonation can be improved by adding, to the final gassing vessel, a portion of the active magnesium oxide required for displacing said calcium in its lime salts. The amount of active MgO to be added to the final carbonation gassing vessel and to the secondary reaction vessel is dictated by the juice quality. That is, a progressively larger amount of active MgO is added to the carbonation gassing vessel with progressively lower effective alkalinities in the said juice, while the amount of active MgO added to the secondary reaction vessel sequenced behind the carbonation gassing vessel remains fairly constant. For example:

With a negative effective alkalinity for the first carbonation juice of −0.02% CaO, it may require up to one pound of active MgO per ton of sugarbeets processed added to the final carbonation gassing vessel, where the juice is overcarbonated to an alkalinity of about 0.01% CaO. An additional 0.5 lbs active MgO per ton of sugarbeets processed is added to the reaction vessel sequenced behind the final carbonation vessel to restore juice alkalinity to about 0.025% CaO.

SPECIFIC EXAMPLE

Clarified sugar beet juice with a so-called effective alkalinity of − 0.02% CaO equivalent and having been treated by one of a number of juice purification systems and now being ready for final carbonation to reduce final lime salts to a minimum is gassed in a suitable vessel with carbon dioxide gas to an alkalinity of 0.01% CaO equivalent while adding 1 lb. of active magnesuim oxide for each ton of sugar beets processed to the final carbonation vessel.

The mixture of the active MgO, carbon dioxide, and clarified beet liquor is taken from the gassing vessel after thorough mixing of all reaction components to a secondary reaction vessel where additional active magnesium oxide representing 0.5 lbs active MgO per ton of sugar beets processed is added. This secondary reaction vessel should provide a total retention time of about 15 minutes and should be equipped to provide additional heating to maintain temperatures in the range of 92° - 95° C.

The final reacted mixture is then filtered. The filtrate contains about 0.05% CaO equivalent on dissolved solids of lime salts and about 0.35% CaO equivalents on dissolved solids as magnesuim salts. The tendency of this juice to scale heating surfaces during evaporation is greatly reduced while gaining about 10 lbs. of additional sugar crystallized in the crystallization process.

We claim:

1. In the purification of raw sugarbeet juice having relatively low or even negative so-called effective alkalinity involving the treatment of the juice with an alkaline earth metal oxide and with carbon dioxide and separating precipitated solids from the liquid phase of the treated material, the improvement which comprises overcarbonating the juice to an alkalinity of 0.0 to 0.02% CaO equivalent during final carbonation in a gassing vessel; adding sufficient active MgO into the gassing vessel while carbonating to raise the effective alkalinities to around 0; and, subsequently, re-alkalizing the overcarbonated juice to an alkalinity of 0.01 to 0.03% CaO equivalent by the addition of active MgO, followed by a final separation of precipitated solids.

* * * * *